US011280498B2

(12) United States Patent
Cowan et al.

(10) Patent No.: US 11,280,498 B2
(45) **Date of Patent: *Mar. 22, 2022**

(54) RETRACTING AND EXTENDING CONTROL SELECTORS

(71) Applicant: Midea Group Co., Ltd., Foshan (CN)

(72) Inventors: Richard W. Cowan, Louisville, KY (US); Felix Conde Zelocuatecatl, Louisville, KY (US); John Hooker, Louisville, KY (US); Vern A. Neal, Louisville, KY (US); Nathan E. Nelson, Louisville, KY (US); Daniel J. Trice, Louisville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 0 days.

This patent is subject to a terminal disclaimer.

(21) Appl. No.: 16/984,659

(22) Filed: Aug. 4, 2020

(65) Prior Publication Data

US 2020/0363067 A1 Nov. 19, 2020

Related U.S. Application Data

(63) Continuation of application No. 16/135,728, filed on Sep. 19, 2018, now Pat. No. 10,739,011.

(51) Int. Cl.

| | |
|---|---|
| ***F24C 3/12*** | (2006.01) |
| ***G05G 5/06*** | (2006.01) |
| ***G05G 1/10*** | (2006.01) |
| ***G05G 5/00*** | (2006.01) |
| ***G05G 1/08*** | (2006.01) |

(52) U.S. Cl.
CPC ..... *F24C 3/126* (2013.01); *F24C 3/122* (2013.01); *F24C 3/124* (2013.01); *G05G 1/082* (2013.01); *G05G 1/10* (2013.01); *G05G 5/005* (2013.01); *G05G 5/06* (2013.01)

(58) Field of Classification Search
CPC ..... F24C 3/122; F24C 3/124; F24C 3/126; G05G 5/005; G05G 5/05; F05G 1/082; F05G 1/087; A47J 37/0713; A47J 37/0727
See application file for complete search history.

(56) References Cited

U.S. PATENT DOCUMENTS 3,556,624 A 1/1971 Voeke et al.
5,321,229 A 6/1994 Holling et al.
(Continued)

FOREIGN PATENT DOCUMENTS

CN 1833140 A 9/2006
CN 104949162 A 9/2015
(Continued)

OTHER PUBLICATIONS

International Search Report and Written Opinion issued in Application No. PCT/CN2018/124347 dated Jun. 18, 2019.
(Continued)

*Primary Examiner* — David J Laux
(74) *Attorney, Agent, or Firm* — Middleton Reutlinger

(57) ABSTRACT

A system for inhibiting and providing access to appliance control knobs includes a support structure for mounting individual control knobs or groups thereof, and an actuator assembly for extending and retracting control knobs either individually or collectively.

20 Claims, 10 Drawing Sheets

(56) References Cited

U.S. PATENT DOCUMENTS

| | | | | |
|---|---|---|---|---|
| 5,384,442 | A | 1/1995 | Danner | |
| 6,843,243 | B2 | 1/2005 | Steurer | |
| 6,998,585 | B2 | 2/2006 | Erdmann | |
| 8,178,802 | B2 | 5/2012 | Roose et al. | |
| 8,967,019 | B2 | 3/2015 | O'Keefe et al. | |
| 10,739,011 | B2 * | 8/2020 | Cowan | F24C 3/124 |
| 2009/0206070 | A1 | 8/2009 | Ortner et al. | |
| 2017/0023255 | A1 * | 1/2017 | Bach | F24C 7/083 |
| 2017/0235328 | A1 | 8/2017 | Swayne et al. | |

FOREIGN PATENT DOCUMENTS

| | | | |
|---|---|---|---|
| CN | 205285993 | U | 6/2016 |
| CN | 106871169 | A | 6/2017 |
| DE | 2929474 | A1 | 3/1980 |
| EP | 0102332 | A1 | 3/1984 |
| EP | 0388375 | A2 | 9/1990 |
| EP | 2584704 | A2 | 4/2013 |
| EP | 3098520 | A1 | 11/2016 |
| FR | 2435003 | A1 | 3/1980 |

OTHER PUBLICATIONS

IGuardStove "Did You Leave The Stove On? iGuardStove—The Automatic Stove Shut Off Device." www.iGuardFire.com. Jul. 29, 2018.

Samsung. "Using the Child Lock on Your Electric Cooktop." www.samsung.com. Jul. 29, 2018.

Neff. "How to Unlock a Neff Induction Hob." www.cookersandovens.co.uk. Jul. 29, 2018.

* cited by examiner

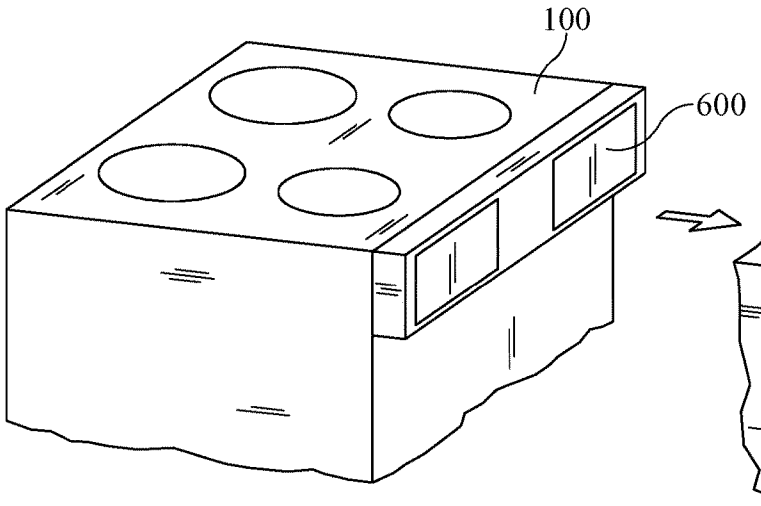
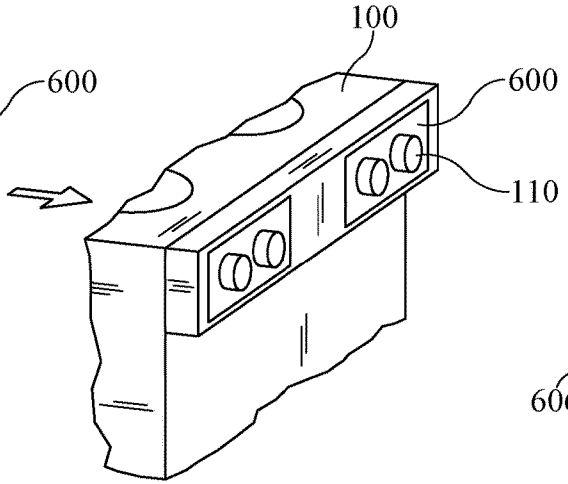
FIG. 12
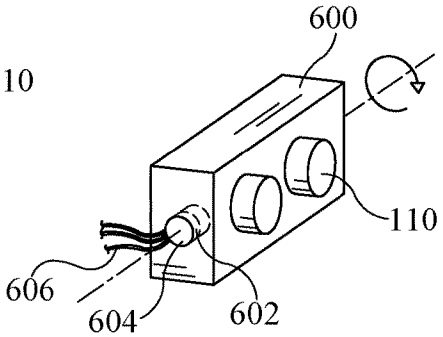
FIG. 13
FIG. 14
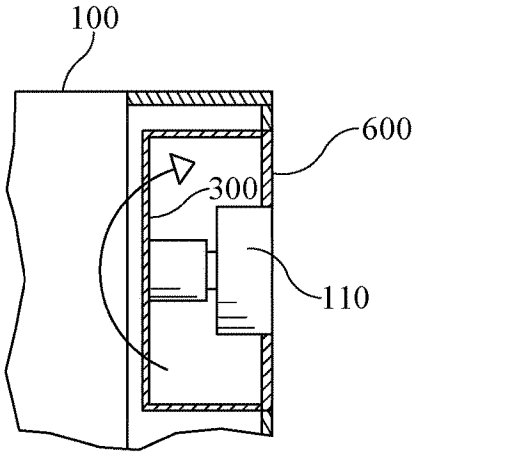
FIG. 15
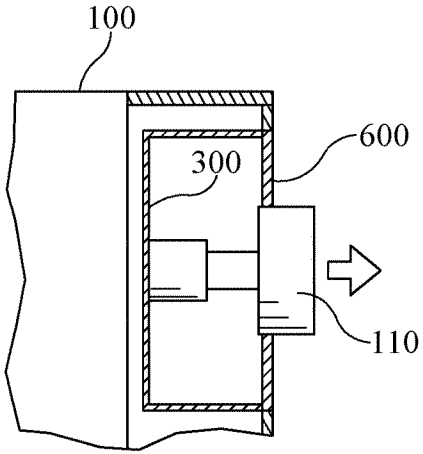
FIG. 16

RETRACTING AND EXTENDING CONTROL SELECTORS

BACKGROUND OF THE INVENTION

In appliance manufacturing industries generally, and specifically in the range or cooking appliance manufacturing industries, most appliances such as cooktops or ranges have a variety of control or selector knobs for adjusting and controlling the amount of heat supplied to the various appliance burners or heating elements. Typically, these knobs are easily accessible to the average user, thereby making them simple and quick to operate, but also providing ready access to children and others lacking the requisite judgment to safely operate the appliance.

In order to provide a measure of safety to oven and cooktop appliances, manufacturers have equipped some control knobs and selectors with simple lockout mechanisms. For example, some control knobs are mounted on spring-loaded shafts that require a user to push or depress the knob slightly before it will turn, thereby providing at least a small measure of child-safety lockout protection. Gas appliances are typically equipped with these push-unlock valves as a mechanism to prevent accidental valve operation but they do not offer a reliable safety lockout mechanism.

Various other child lockout systems have been provided in the industry, with varying degrees of safety and operability. There does not exist, however, a reliable system for providing child safety control to an appliance that simultaneously provides ease of access and use for an adult user.

From the foregoing it can readily be seen that there is a need in the art for control knob safety lockout system that can be employed with individual appliances to control access to appliance controls without adding significantly hindrances to appliance use.

SUMMARY OF THE INVENTION

The present disclosure is related to systems and apparatus for providing control knob or selector safety controls for an appliance. The system described herein utilizes a retractable and extendable knob or selector assembly mounted in the appliance that may be selectively operated. The control knobs or selectors may be extended outwardly from a recess provided within the appliance, either individually or together, thereby providing access for operation. Additionally, the control knobs or selectors may be retracted, either individually or together, into the recess thereby prohibiting operation of the appliance controls and providing a system for safely locking the controls.

In various embodiments, the system disclosed herein provides an access control that, when activated, provides access to at least one control knob by extending that control knob to a usable position. In various embodiments access control may be a switch, pushbutton or other manipulable selector that unlocks or provides access to at least one control knob. In other aspects and embodiments access control may be a programmable selector on a user interface, or a remotely located selector that provides access to an authorized user to unlock at least one control knob.

In other embodiments, the system and methods disclosed herein may include a control knob assembly that includes a support structure capable of linear motion to extend and retract the control knob responsive to an access control. Additionally and alternatively the system and methods disclosed herein may be used to provide a support structure that includes a plurality of control knobs or selectors that are extended and/or retracted as a group, or alternatively that are extended and/or retracted individually responsive to an access control.

In various aspects and embodiments the system described herein may include a processor having a plurality of inputs and outputs that are operatively coupled to various components of an appliance, including an access control, for effecting extension and retraction of a plurality of control knobs, either individually or in a group or groups. In some embodiments processor may be coupled with a user interface that is suitably programmed to provide an access control selection that may be initiated by a user to extend or retract control knobs.

In other embodiments the apparatus described herein may provide a sliding, pivoting, or rotating panel or drawer on which control knobs and concomitant support structure are mounted, wherein the panel or drawer may positioned in a closed position to deny access to control knobs and correspondingly opened when an access control is selected on the appliance.

As used herein for purposes of the present disclosure, the term "appliance" should be understood to be generally synonymous with and include any device that consumes electrical power and can be connected to an electrical circuit or battery, for example one used in a residential or commercial setting to accomplish work. The appliances referred to herein may include a plurality of electrically operated components powered by the circuit, the components operable by manipulation of control knobs or selectors. The appliances referred to herein may also include a gas supply or source and one or more gas valves for supplying gas to a burner or heating element. The appliance gas valves may be controlled by a selector or knob, either directly or indirectly, and the appliance may also include a processor or processors that operate, control and monitor the appliance and the various components and functions thereof referred to throughout this specification.

The terms "knob" or "selector" are used herein generally to describe various devices that are operatively coupled to functional components of the appliance and which may typically, but not exclusively, be operated by hand by a user. Typical control knobs and selectors include but are not limited to gas and electric burner controls, gas and electric oven controls, lighting and timing controls, start and stop controls, switches, sliders, pushbuttons, wheels, levers, and various other functional controls associated with an appliance. "Selector" may also be used to refer to a programmed button selection on a touch-screen or similar operator interface.

The term "controller" or "processor" is used herein generally to describe various apparatus relating to the operation of the system and the appliances referred to herein. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), programmable logic controllers (PLCs), and field-programmable gate arrays (FPGAs).

A processor or controller may be associated with one or more storage media (generically referred to herein as "memory," e.g., volatile and non-volatile computer memory such as RAM, PROM, EPROM, and EEPROM, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present disclosure discussed herein. The terms "program" or "computer program" are used herein in a generic sense to refer to any type of computer code (e.g., software or microcode) that can be employed to program one or more processors or controllers.

The term "Internet" or synonymously "Internet of things" refers to the global computer network providing a variety of information and communication facilities, consisting of interconnected networks using standardized communication protocols. The appliances, controllers and processors referred to herein may be operatively connected to the Internet.

It should be appreciated that all combinations of the foregoing concepts and additional concepts discussed in greater detail below (provided such concepts are not mutually inconsistent) are part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. The drawings are not necessarily to scale. Emphasis is instead generally placed upon illustrating the principles of the disclosure, wherein;

FIG. 12 is a perspective view of an appliance having a retraction and extension assembly in accordance with some aspects and embodiments;

FIG. 13 is a perspective view of an appliance having a retraction and extension assembly in accordance with some aspects and embodiments;

FIG. 14 is a partial view of a retraction and extension assembly in accordance with some aspects and embodiments;

FIG. 15 is a partial view of a retraction and extension assembly in accordance with some aspects and embodiments;

FIG. 16 is a partial view of a retraction and extension assembly in accordance with some aspects and embodiments;

DETAILED DESCRIPTION OF THE INVENTION

Referring to drawing FIGS. 1-7, and in accordance with various aspects and embodiments of the invention, a system 10 for retractable and extendable control knobs or selectors for an appliance 100 is described. In various embodiments the appliance 100 in which system 10 is implemented may include a controller 200 integral to appliance 100 that operates appliance 100 and implements various embodiments and aspects of system 10 as described herein.

Figure 1:
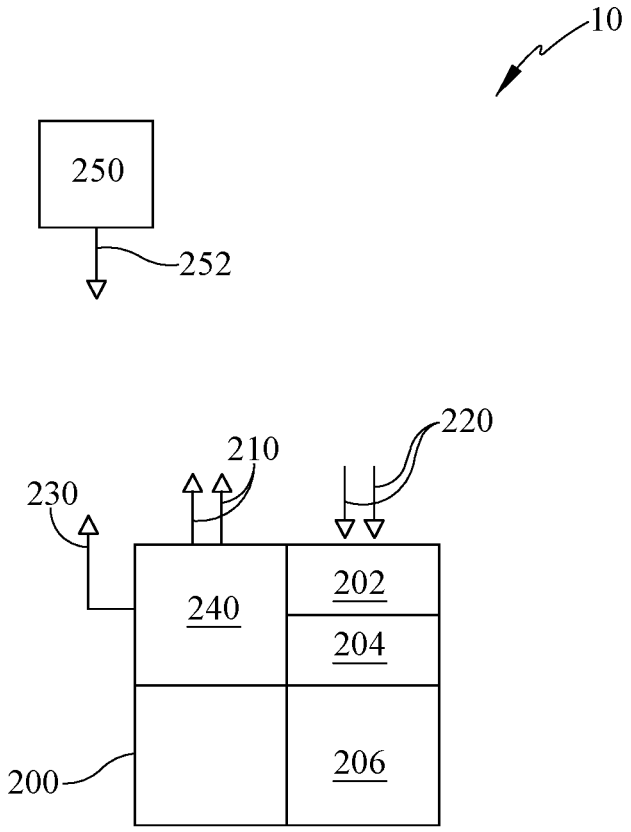
FIG. 1 is a block diagram of a control system that may be used in conjunction with an appliance in accordance with various embodiments.

FIG. 1 illustrates an exemplary appliance 100 hardware environment for implementing system 10 for retractable and extendable control knobs. The system 10 may include a controller 200, a processor or processors 202 and concomitant memory 204. Appliance 100 may further comprise a plurality of signal outputs 210 and signal inputs 220 that may be operatively connected to a plurality of appliance 100 components to monitor and direct system 10 operation. Furthermore, in some embodiments controller 200 may include a wireless or hard-wired communications interface 230 that enables controller 200 to communicate with external devices or communications networks such as the internet, that may be integrated into system 10.

Additionally, controller 200 may be equipped with an operator or user interface 240 to provide audible or visual feedback to a user as well as provide a user the ability to provide instructions or commands to controller 200. Exemplary but non-limiting user interfaces that may be employed include a mouse, keypads, touch-screens, keyboards, switches and/or touch pads. Any user interface may be employed for use in the invention without departing from the scope thereof. It will be understood that FIG. 1 constitutes, in some respects, an abstraction and that the actual organization of the components of appliance 100 and controller 200 may be more complex than illustrated.

The processor 202 may be any hardware device capable of executing instructions stored in memory 204 or data storage 206 or otherwise processing data. As such, the processor may include a microprocessor, field programmable gate array (FPGA), application-specific integrated circuit (ASIC), or other similar devices.

The memory 204 may include various memories such as, for example L1, L2, or L3 cache or system memory. As such, the memory 204 may include static random access memory (SRAM), dynamic RAM (DRAM), flash memory, read only memory (ROM), or other similar memory devices. It will be apparent that, in embodiments where the processor includes one or more ASICs (or other processing devices) that implement one or more of the functions described herein in hardware, the software described as corresponding to such functionality in other embodiments may be omitted.

The user interface 240 may include one or more devices for enabling communication with a user such as an administrator. For example, the user interface 240 may include a display, a mouse, and a keyboard for receiving user commands. In some embodiments, the user interface 240 may include a command line interface or graphical user interface that may be presented to a remote terminal via the communication interface 230.

The communication interface 230 may include one or more devices for enabling communication with other hardware devices. For example, the communication interface 230 may include a network interface card (NIC) configured to communicate according to the Ethernet protocol. Additionally, the communication interface 230 may implement a TCP/IP stack for communication according to the TCP/IP protocols. Various alternative or additional hardware or configurations for the communication interface 230 will be apparent.

The storage 206 may include one or more machine-readable storage media such as read-only memory (ROM), random-access memory (RAM), magnetic disk storage media, optical storage media, flash-memory devices, or similar storage media. In various embodiments, the storage 206 may store instructions for execution by the processor 202 or data upon with the processor 202 may operate. For example, the storage 206 may store a base operating system for controlling various basic operations of the hardware. Other instruction sets may also be stored in storage 206 for executing various functions of system 10, in accordance with the embodiments detailed below.

It will be apparent that various information described as stored in the storage 206 may be additionally or alternatively stored in the memory 204. In this respect, the memory 204 may also be considered to constitute a "storage device" and the storage 206 may be considered a "memory." Various other arrangements will be apparent. Further, the memory 204 and storage 206 may both be considered to be "non-transitory machine-readable media." As used herein, the term "non-transitory" will be understood to exclude transitory signals but to include all forms of storage, including both volatile and non-volatile memories.

While the controller 200 is shown as including one of each described component, the various components may be duplicated in various embodiments. For example, the processor 202 may include multiple microprocessors that are configured to independently execute the methods described herein or are configured to perform steps or subroutines of the methods described herein such that the multiple processors cooperate to achieve the functionality described herein.

Referring now to FIGS. 2-6, and in accordance with some embodiments, a system 10 for retracting and extending control selectors for an appliance 100 includes a plurality of control knobs 110 (alternatively selector knobs 110), that are utilized to operate appliance 100. It should be understood that any appliance 100 or other device that utilized control or selector knobs 110 wherein it would be desirable to control access thereto may be employed as a part of system 10 without departing from the scope of the invention.

In one non-limiting exemplary embodiment for purposes of illustration in this specification, appliance 100 may be a conventional stove 100, (or equivalently a cooktop and oven combination). Stove 100 may include multiple control knobs 110, for example control knobs to adjust the function of a plurality of cooktop burners as well as a plurality of oven heating elements. Other control knobs 110 for adjusting or operating various appliance 100 controls may also be present, but for purposes of explication have been omitted from this example. In one exemplary but non-limiting embodiment that will be used throughout this specification for purposes of explication, the control knobs 110 may be assumed to operate a plurality of temperature controls, for example gas cooktop burners and/or gas oven burners. The actual function of the control knobs 110 or selectors in this example is not material to the invention, but rather is used herein for purposes of illustrating the operation and various functions of system 10.

As shown in FIGS. 2 and 3, and again using the example of a gas control knobs 110, the plurality of control knobs 110 may be mounted to a support structure 300 that may in some embodiment include an encoder plate 320 having a plurality of knob mounting apertures 322 into which knobs 110 are positioned. Knobs 110 are typically two-piece knobs, having a rotatable outer portion 112 and a fixed inner portion 114 that is used to mount control knobs 110. Encoder plate 320 may include a plurality of guide rods 330 extending mounted at a plurality of points on plate 320 and extending outwardly toward control knobs 110. An encoder board 340 is provided, having a plurality of encoders 342 secured thereto for engaging rotatable outer portion 112 of control knobs 110.

Encoder board 340 in some aspects and embodiments functions as a circuit board onto which a plurality of encoders 342 are soldered or otherwise electrically operatively mounted. Encoders 342 may each have an output (not shown) that is operatively coupled to a controller 200 input 220, that is representative of the amount of heat (or gas) to be supplied to the burner of appliance 100. Alternatively, and in accordance with some embodiments the encoder 342 output may be supplied directly to an electromechanical gas valve for changing the gas valve position. In another exemplary embodiment encoder board 340 may have a plurality of rotary potentiometers 342 secured thereto (in place of encoders) that engage rotatable outer portion 112 of control knobs 110. This embodiment is useful where a simple current or voltage control signal is desired from control knob 110 to control a function of appliance 100, for example in the use of an electric burner, or other electrically operated control.

Figure 2:
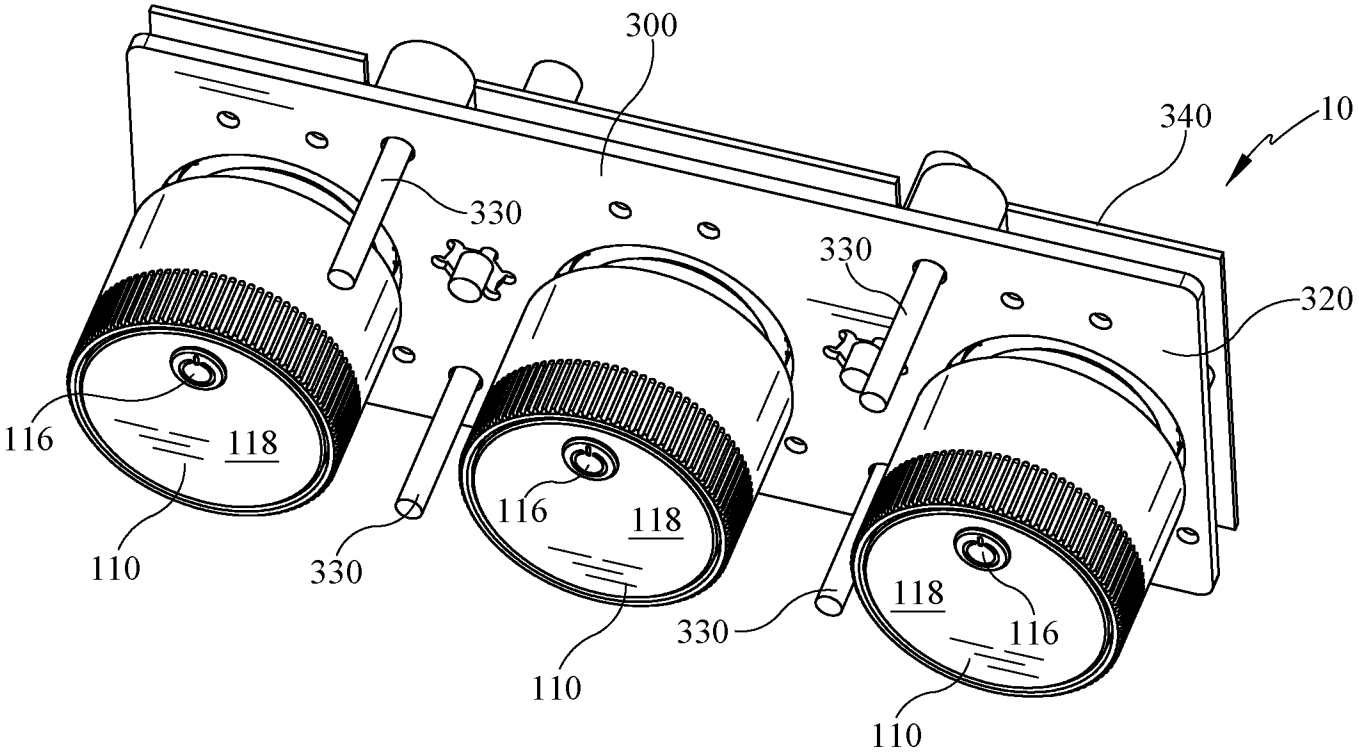
FIG. 2 is an exploded perspective view of an assembly of a plurality of control knobs of an appliance in accordance with various embodiments.
Figure 3:
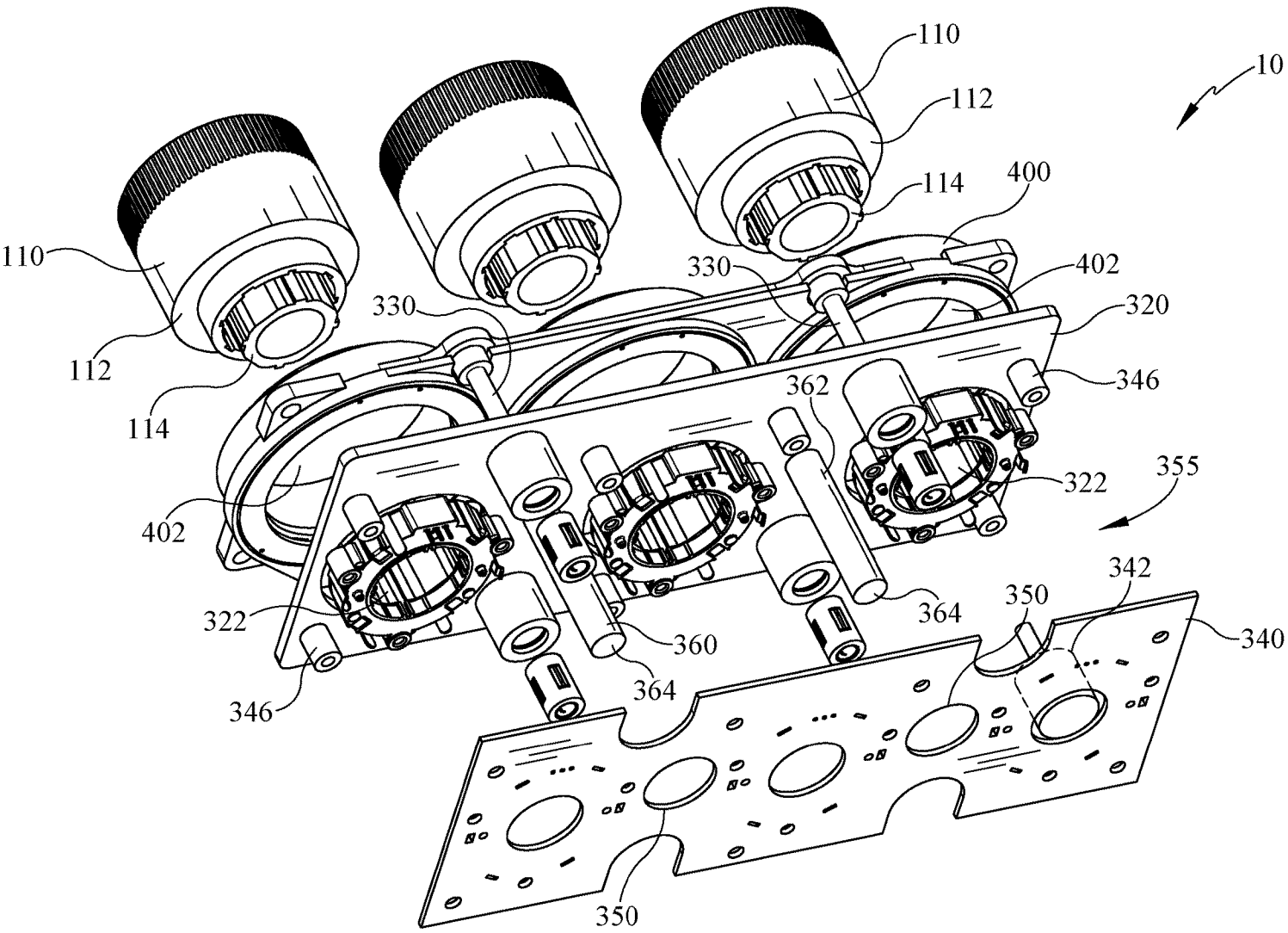
FIG. 3 is a perspective view of a retraction and extension assembly in accordance with some aspects and embodiments.
Figure 4:
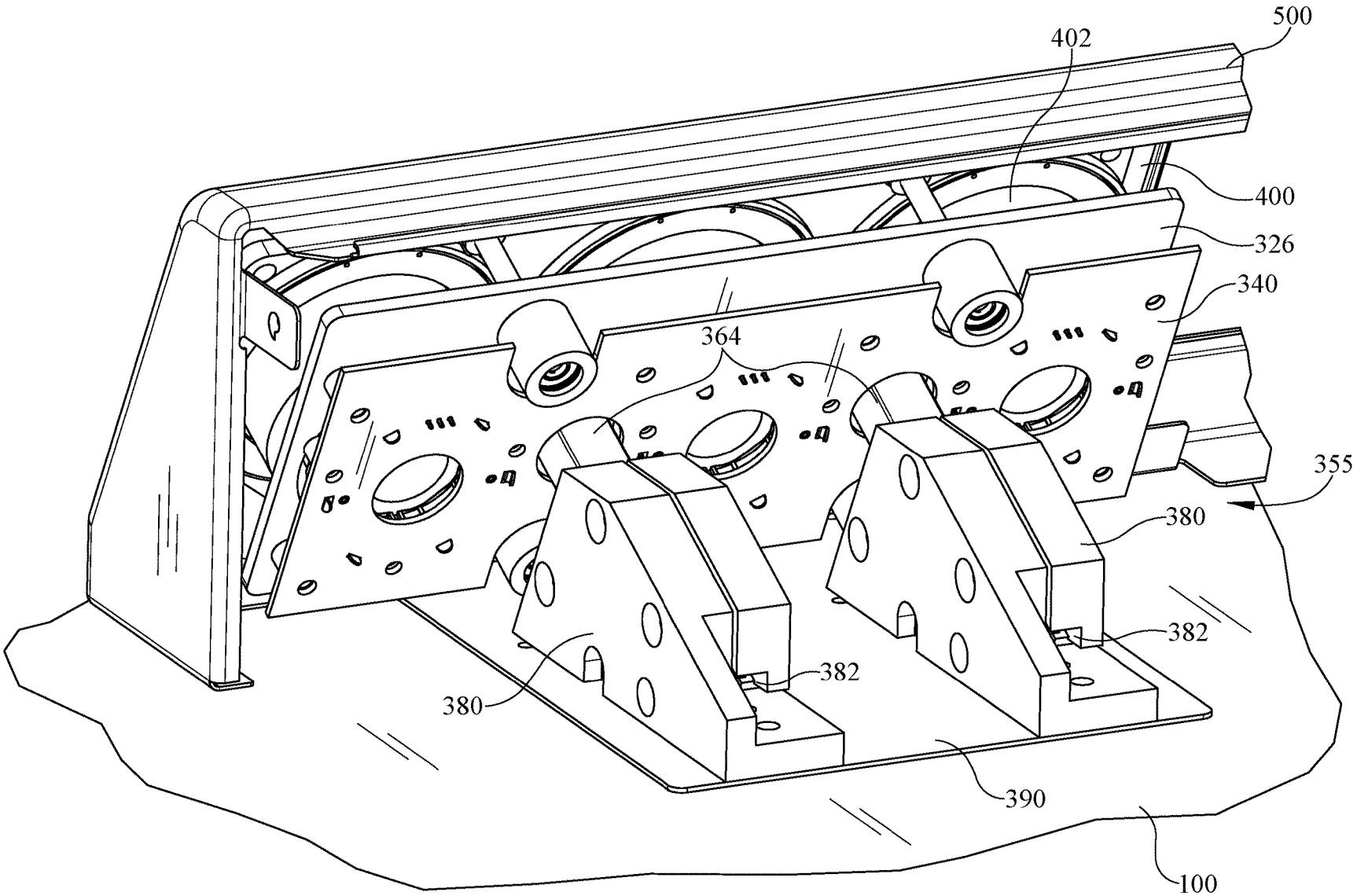
FIG. 4 is a perspective view of a guide plate and guide rods in accordance with some aspects and embodiments.
Figure 5:
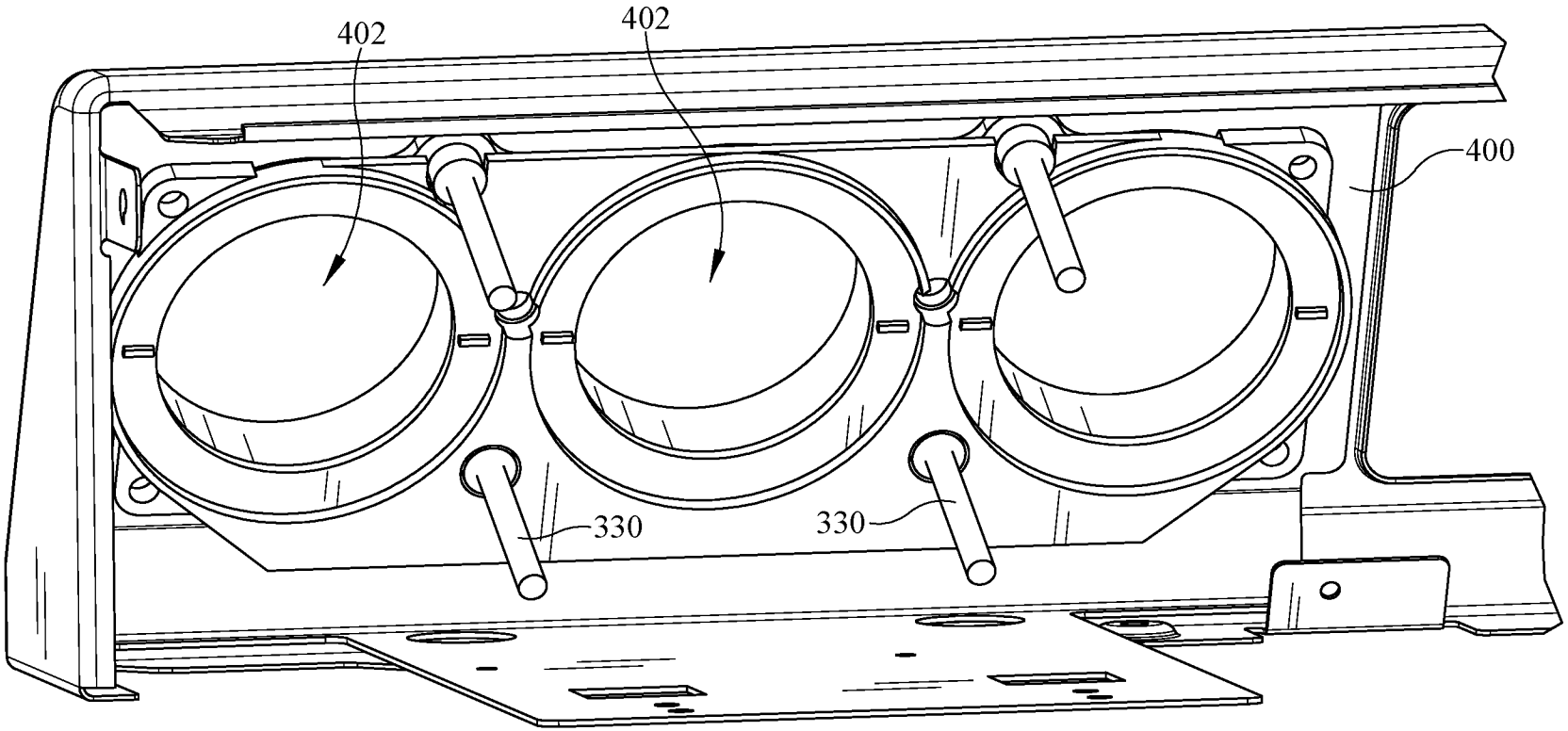
FIG. 5 is an exploded perspective view of a retraction and extension assembly in accordance with some aspects and embodiments.
Figure 6:
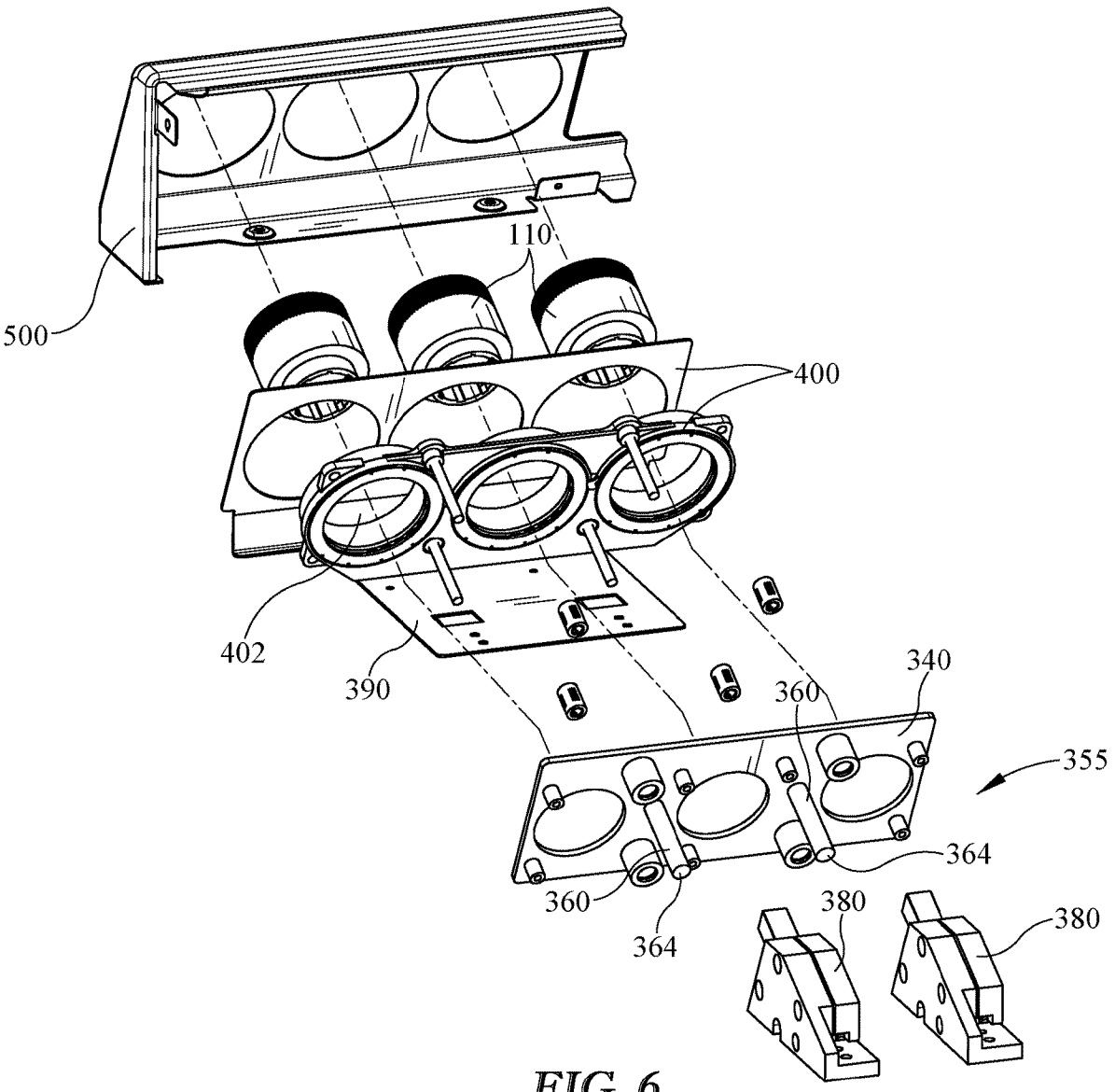
FIG. 6 is an exploded perspective view of a retraction and extension assembly in accordance with some aspects and embodiments.
Figure 7:
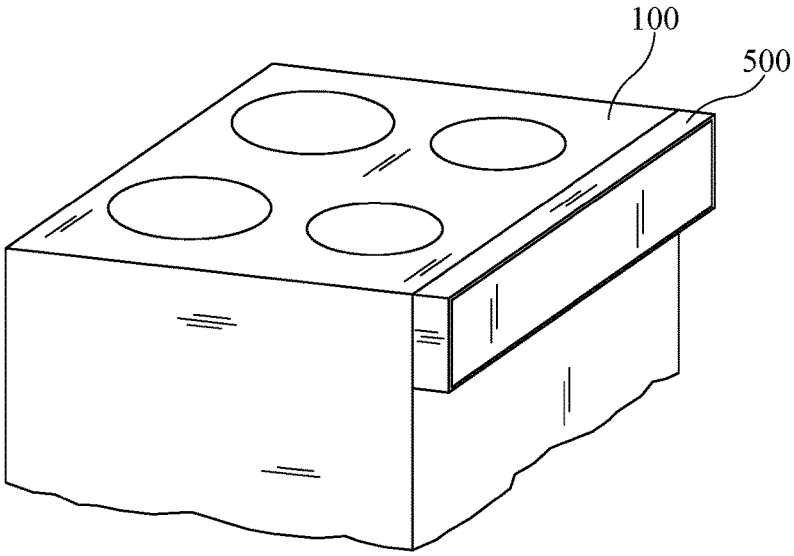
FIG. 7 is a perspective view of an appliance having a retraction and extension assembly in accordance with some aspects and embodiments.
Figure 9:
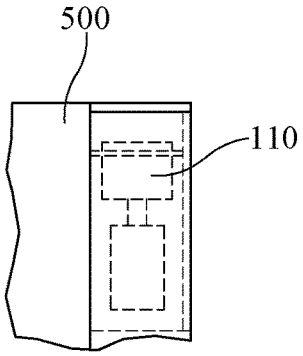
FIG. 9 is a partial view of a retraction and extension assembly in accordance with some aspects and embodiments.
Figure 10:
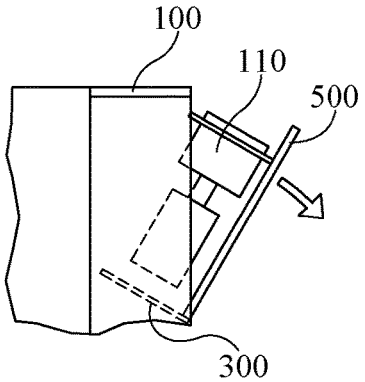
FIG. 10 is a partial view of a retraction and extension assembly in accordance with some aspects and embodiments.

As best seen in FIGS. 2-4, encoder board 340, which may in some embodiments be a circuit board or circuit board substrate, may be secured to encoder plate 320 via a plurality of spacers 346. Encoder board 340 is secured to an actuator assembly 355 having a plurality of actuators 360 and pivot supports 380. Encoder board 340 includes a plurality of apertures 350 through which actuators 360 extend. Actuator assembly 355 may in some aspects include linear actuators 360 that are secured at a first end 362 to encoder plate 320 via conventional fasteners. Actuators 360 may be pivotally secured at a second end 364 to a pivot support 380. Actuators 360 in some exemplary embodiments may be linear actuators 360 or worm gears, but a wide variety of actuators 360 may be employed to impart linear motion to without departing from the scope of the invention. Furthermore, actuators 360 are operatively coupled to an output 210 of controller 200, thereby enabling them to extend or retract and impart linear motion to support structure 300. This linear motion of support structure 300 acts to extend and/or retract control knobs 110 responsive to a command from controller 200 output 210.

As best seen in FIGS. 3-6 and in some embodiments, actuator assembly 355 may also include pivot supports 380 that include a hinge 382 that permit second end 364 of actuator 360 to pivot slightly as support structure 300 is extended and retracted, thereby providing linear motion to support structure 300. Pivot support 380 may be secured to a support plate 390, or an equivalent structure 390 of appliance 100 to provide a secure platform from which to extend and retract control knobs 110.

Figure 20:
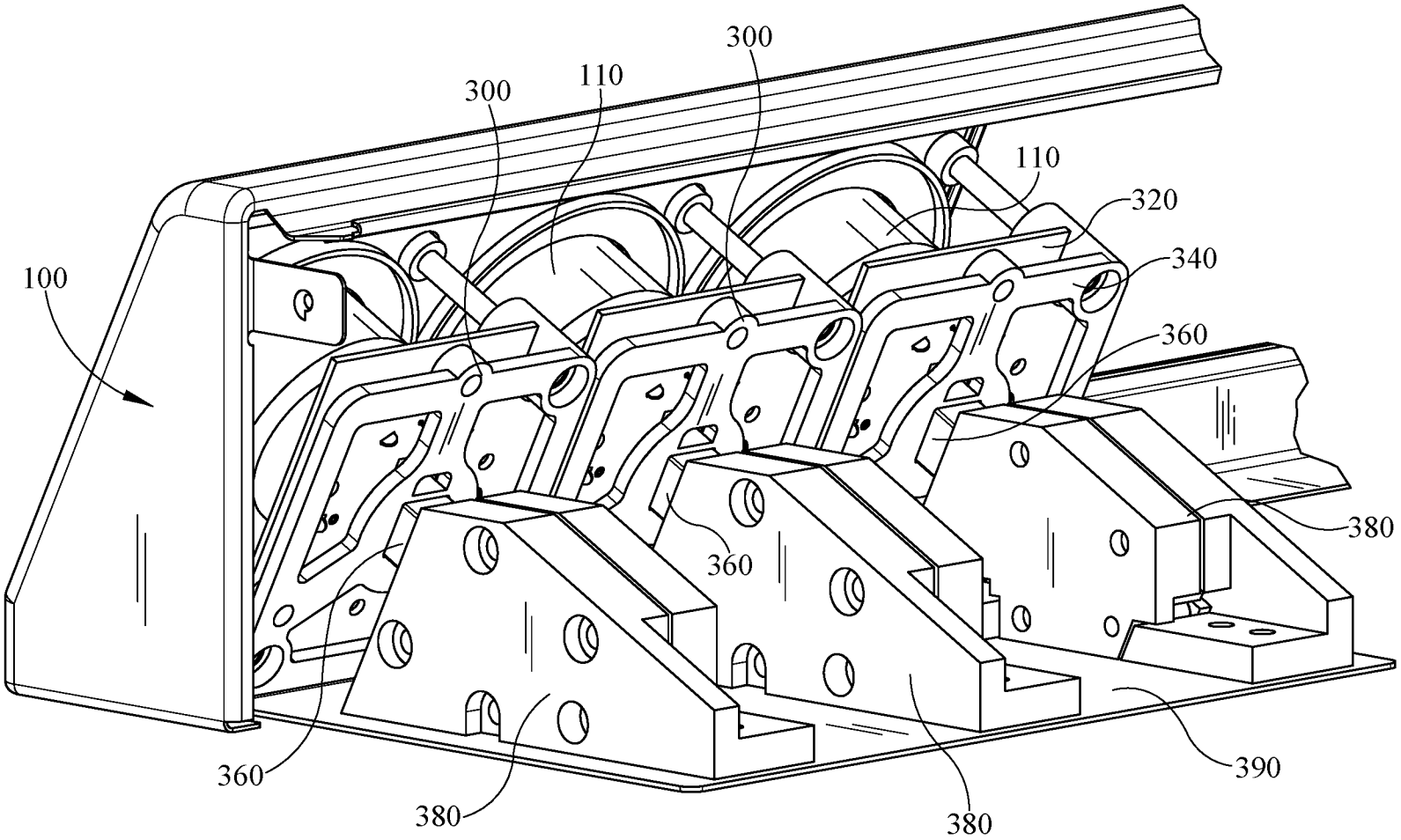
FIG. 20 is a perspective view of a retraction and extension assembly in accordance with some aspects and embodiments.

While the aforementioned support structure 300 has, in this exemplary embodiment, been depicted as providing linear motion to extend and retract three ganged control knobs 110, all secured to and moving with the same encoder plate 320, it should be understood from the disclosure that the support structure 300 may be adapted to mount a single knob 110, or a grouped set of knobs 110 without departing from the scope of the invention. In an exemplary embodiments as depicted in FIG. 20, a plurality of control knobs 110 may be secured to individual support structures 300, having individual encoder plates 320, encoder boards 340, and actuators 360 responsive to access control. Accordingly, individual control knobs 110 may thus be retracted and extended responsive to a command from controller 200, while in other embodiments a group of control knobs 110 may be mounted on a support structure together, and thus retracted and extended together.

In various exemplary embodiments a bezel guide plate 400 having a plurality of knob apertures 402 may be provided, secured to support structure 300 encoder plate 320 and guide rods 330. Bezel guide plate apertures 402 may be shaped to accept control knobs 100 there through and be spaced such that the fronts of control knobs 110 are generally even with apertures 402 when knobs 110 are in a retracted position, so that retracted knobs can't be accessed by a user until they are extended. Furthermore, a decorative and protective cover 500 may extend over and be secured to the entire support structure 300 to provide protection to knobs 110, bezel guide plate 400, and encoder plate 320 during use of appliance 100.

Referring again to FIG. 1, and in various aspects and embodiments of system 10 an access control 250 is provided for retracting and extending control knobs 110. Access control 250 may in some embodiments include an output 252 operatively coupled to an input 220 of controller 200. When selected, access control 250 output 252 indicates to controller 200 to extend (or retract) control knobs 110, depending on their position when access control 250 is selected. For example, if control knobs 110 are retracted and access control 250 is selected, controller 200 provides an output 210 to actuators 360 to extend control knobs 110. Similarly, if control knobs 110 are extended and access control 250 is selected, controller 200 provides an output 210 to actuators 360 to retract control knobs 110.

In accordance with some aspects of the disclosure, access control 250 may be a switch or selector knob 250 having an output 252 operatively coupled to processor 200. In yet further aspects and embodiments selector knob 250 may be a switch that simply supplies operating power to actuators 260, thereby obviating the need for processor 200 entirely. In these embodiments, access control 250 may be positioned on appliance 100 in a position such that children may have difficulty reaching and using access control 250. In other embodiments, access control 250 may be remotely located from appliance 100, yet still provide the requisite input 220 to controller 200 via a hardwired or wireless link. Additionally, access control 250 may be a touch selection on user interface 240. In these embodiments a "retract" and "extend" touch selector may be provided on user interface 240 to initiate the desired function through processor 200 outputs 210. In some aspects and embodiments user interface 240 may be provided on a remote device, such as a smart phone or touch panel located remotely from appliance 10.

In yet further aspects and embodiments, access control 250 may be a voice recognition module that may be programmed to recognize a specific voice or voices, having an output operatively coupled to processor 200 that is provided when a predetermined voice is detected by module 250. In these embodiments, a specific commands such as "retract", "sleep", or "extend", "wake" may be pre-programmed by a user to cause processor to provide an output 210 to actuators 260 to retract or extend control knobs 110. In some aspects and embodiments, access control 250 may comprise a facial and gesture recognition system 250 that includes an output operatively coupled to processor 200 to extend and retract control knobs 110 when facial and gesture recognition system 250 captures or "recognizes" a pre-programmed face or gesture.

In some additional aspects and embodiments, where appliance 100 processor 200 has not received an input for a predetermined time period and/or when control knob 110 encoders 342 are in an "off" position for a predetermined time period, as determined by processor 200, an output 210 may be provided to retract control knobs 110, thereby assuring appliance 100 is not operated until unlocked by a user. In application where appliance 100 is a stove, oven or cooktop, an automatic control knob 100 retract sequence may be initiated by processor 200 when all burners are off (processor 200 detects an "off" signal input 220 from resolvers 342, and have been so for a predetermined time period, for example five minutes.

In yet further aspects and embodiments, and as best depicted in FIG. 2, control knobs 110 may include a separate touch-sensitive button 116 disposed in a front surface 118 of knob 110 that may incorporate aspects of access control for an appliance. Each touch sensitive button 116 may further provide an input 220 to processor 200 to indicate its selection by a user. In one exemplary embodiment, a user may initiate a "lockout" command to turn off all appliance functions and retract control knobs 110 by simultaneously touching or selecting two touch-sensitive buttons 116. In an exemplary embodiment where appliance 100 is a stove, oven, or cooktop, a user may touch or select two touch sensitive buttons 116 simultaneously, thereby initiating a lockout sequence. Upon receiving two simultaneous inputs 220 from touch sensitive buttons 116, processor 200 may in some embodiments turn off power (or gas) to all heating elements and/or burners, and retract control knobs 110, as discussed in detail herein above. In another embodiment, when in lockout mode, simultaneously touching any two touch-sensitive buttons as detected by processor 200 will unlock appliance 100, and initiate the extension of control knobs 110.

Figure 8:
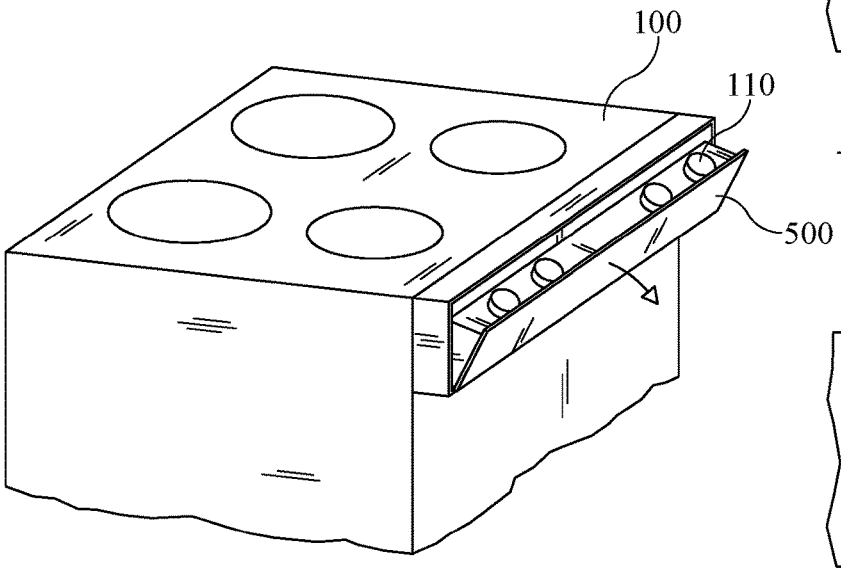
FIG. 8 is a perspective view of a retraction and extension assembly in accordance with some aspects and embodiments.
Figure 11:
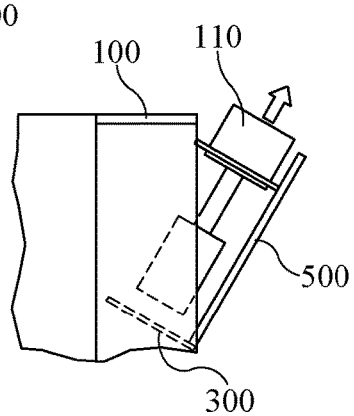
FIG. 11 is a partial view of a retraction and extension assembly in accordance with some aspects and embodiments.

Referring to drawing FIGS. 7-11 in various embodiments control knobs 110 may be mounted or secured inside a pivoting or hinged drawer 500 that, when closed, provides no access to control knobs 110. In these embodiments drawer 500 may operate using a spring-push mechanism to open drawer 500, where a slight inward push releases the drawer to provide access to control knobs 110 as shown in FIG. 8. Control knobs 110 may be mounted to support structure 300 as detailed herein above and then extended once drawer 500 is opened. In some embodiments, drawer 500 may pivot by operation of a conventional solenoid or actuator (not shown) whereby depressing or selecting control access 250 opens drawer 500 and then extends control knobs 110. Similarly, selecting control access a second time retracts control knobs 110 and closes hinged drawer 500, thereby prohibiting further access to the appliance 100 controls.

Referring to drawing FIGS. 12-16 in various embodiments control knobs 110 may be mounted or secured inside a swiveling compartment 600 that, when closed, provides no access to control knobs 110. In these embodiments support structure 300 may be secured to swiveling compartment 600, that is capable of 180 degrees of rotation about a central axis 602, for example by use of an annular bearing 604. A plurality of swiveling compartments 600 may be provided to an appliance 100, to provide and restrict access to a plurality of sets of control knobs 110. In some embodiments, any requisite electrical wiring 604 may be routed through annular bearing 604. Compartments 600 may rotate or swivel by operation of a simple dc motor, or a gear driven by a dc motor. A wide variety of mechanisms may be employed to effect rotation of compartments 600 without departing from the scope of the invention.

In accordance with some embodiments, in operation, access control 250 may be depressed whereupon processor 200 provides an output to energize the motor or actuator to rotate compartment 600 180 degrees, thereby exposing control knobs 110, as depicted in FIGS. 14 and 15. Processor 200 then energizes actuators 360, thereby extending control knobs 110 as described above and depicted in FIG. 16. When access control 250 is depressed or selected a second time, knobs 110 are retracted and compartment 600 is then rotated to prohibit access thereto.

Figure 19:
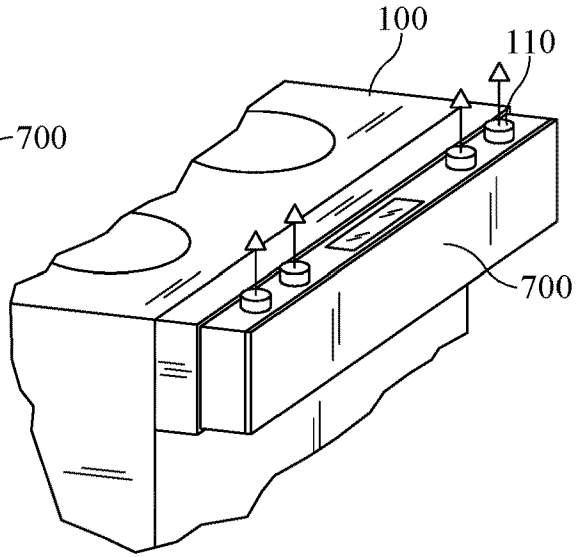
FIG. 19 is a partial view of a retraction and extension assembly in accordance with some aspects and embodiments.
Figure 18:
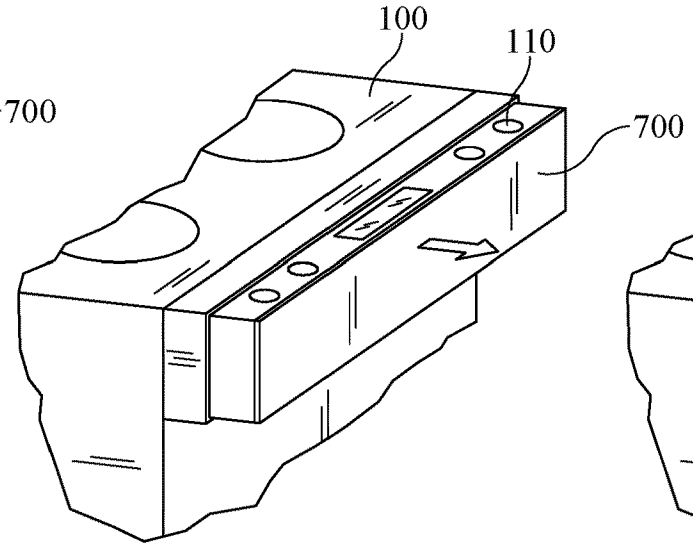
FIG. 18 is a partial view of a retraction and extension assembly in accordance with some aspects and embodiments.
Figure 17:
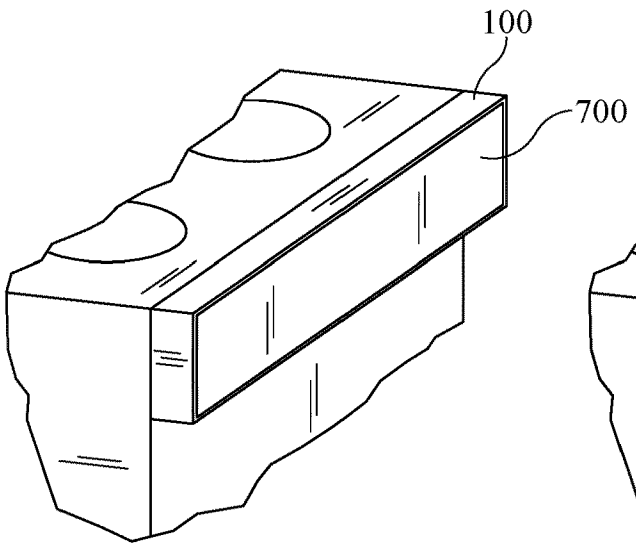
FIG. 17 is a partial view of a retraction and extension assembly in accordance with some aspects and embodiments.

In accordance with additional aspects and embodiments shown in FIGS. 17-19 a sliding drawer or panel 700 may be recessed in a surface of appliance 100 to provide and prohibit access to control knobs 110. Sliding drawer 700 may open and close utilizing a conventional spring latch mechanism, or in an alternative embodiment, a linear actuator 360 or worm gear may be used to slide drawer 700 outwardly when processor 200 receives and input 220 from access control 250. As discussed herein above, control knobs 110 may be secured to a support structure 300 that imparts linear motion thereto once drawer 700 is in an open position, thereby raising control knobs 110 for access, as seen in FIG. 19. In embodiments where sliding drawer 700 is automatically opened and closed by an actuator 360, initiating the access control 250 when knobs 110 are extended reverses the process, retracting control knobs 110 and sliding drawer 700 to a closed position. It should be noted that a wide variety of sliding mechanisms may be incorporated to provide motion to sliding drawer 700 without departing from the scope of the present invention.

While a variety of inventive embodiments have been described and illustrated herein, those of ordinary skill in the art will understand that a variety of other methods, systems, and/or structures for performing the function and/or obtaining the results, and/or one or more of the advantages described herein are possible, and further understand that each of such variations and/or modifications is within the scope of the inventive embodiments described herein. Those skilled in the art will understand that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of" "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03. It should be understood that certain expressions and reference signs used in the claims pursuant to Rule 6.2(b) of the Patent Cooperation Treaty ("PCT") do not limit the scope.

What is claimed is:

1. An appliance comprising:

a rotatable control knob mounted to a support structure and positioned to be extended and retracted for access; and an actuator secured to the support structure for providing linear motion to the support structure, thereby extending and retracting the control knob.

2. The appliance of claim 1, wherein the support structure comprises an encoder plate having an aperture therein and an encoder extending there through to engage the rotatable control knob, the encoder mounted to an encoder board secured to the encoder plate.

3. The appliance of claim 1, wherein the support structure comprises an encoder plate having an aperture therein to engage the rotatable control knob.

4. The appliance of claim 1, wherein the actuator is disposed in an actuator assembly that further comprises a pivot support secured to the appliance and capable of motion around an axis, wherein the actuator is secured at a first end to the pivot support and at a second end to the support structure for providing linear motion to the support structure and the control knob.

5. The appliance of claim 1, wherein the control knob is a first control knob, the appliance further comprising:

a guide plate having first and second guide plate apertures therein, wherein the first control knob is positioned to be extended and retracted through the first guide plate aperture; and a second rotatable control knob mounted to the support structure and positioned to be extended and retracted through the second guide plate aperture;

wherein the actuator is configured to provide linear motion to the support structure to collectively extend and retract the first and second control knobs.

6. The appliance of claim 1, wherein the control knob is a first control knob and the support structure is a first support structure, the appliance further comprising:

a guide plate having first and second guide plate apertures therein, wherein the first control knob is positioned to be extended and retracted through the first guide plate aperture; and a second rotatable control knob mounted to the second support structure and positioned to be extended and retracted through the second guide plate aperture;

wherein the actuator is configured to provide linear motion to the first and second support structures to separately extend and retract the first and second control knobs.

7. The appliance of claim 1, further comprising an access control configured to lock and unlock the actuator and a processor coupled to the access control to lock and unlock the actuator in response to the access control, wherein the access control is a push button, a switch, a user interface, or a remote push button.

8. The appliance of claim 1, wherein the actuator includes a linear actuator or a worm gear.

9. An appliance, comprising:

a guide plate having a plurality of guide plate apertures therein;

a plurality of individual support structures;

a plurality of control knobs, each control knob mounted to one of the individual support structures and positioned to be extended and retracted through one of the guide plate apertures; and a plurality of actuators, each actuator secured to one of the individual support structures and configured to provide linear motion to the one of the individual support structures selectively, thereby selectively extending and retracting the control knob mounted to the one of the individual support structures through the one of the guide plate apertures.

10. The appliance of claim 9, wherein each individual support structure comprises an encoder plate having an aperture therein and an encoder extending there through to engage the control knob mounted thereto, the encoder mounted to an encoder board secured to the encoder plate.

11. The appliance of claim 9, wherein each actuator is disposed in an actuator assembly that further comprises a pivot support secured to the appliance and capable of motion around an axis, and wherein the actuator is secured at a first end to the pivot support and at a second end to one of the individual support structures for providing linear motion to the one of the individual support structures and the control knob mounted thereto.

12. The appliance of claim 9, further comprising an access control configured to lock and unlock the plurality of actuators and a processor coupled to the access control to lock and unlock the plurality of actuators in response to the access control, wherein the access control is a push button, a switch, a user interface, or a remote push button.

13. The appliance of claim 9, wherein each actuator includes a linear actuator or a worm gear.

14. The appliance of claim 9, further comprising a processor coupled to first and second control knobs among the plurality of control knobs and configured to actuate the plurality of actuators to selectively extend and retract the plurality of control knobs in response to simultaneous selection of the first and second control knobs.

15. An appliance, comprising:

a guide plate having a plurality of apertures therein;

a group of rotatable control knobs mounted to a support structure and positioned to be extended and retracted through the plurality of guide plate apertures; and an actuator secured to the support structure and configured to provide linear motion to the support structure, thereby selectively extending and retracting the group of control knobs through the plurality of guide plate apertures.

16. The appliance of claim 15, wherein the actuator is disposed in an actuator assembly that further comprises a pivot support secured to the appliance and capable of motion around an axis, and wherein the actuator is secured at a first end to the pivot support and at a second end to the support structure for providing linear motion to the support structure and the group of control knobs.

17. The appliance of claim 15, further comprising an access control configured to lock and unlock the actuator and a processor coupled to the access control to lock and unlock the actuator in response to the access control, wherein the access control is a push button, a switch, a user interface, or a remote push button.

18. The appliance of claim 15, wherein the actuator includes a linear actuator or a worm gear.

19. The appliance of claim 15, further comprising a processor coupled to first and second control knobs among the group of control knobs and configured to actuate the actuator to selectively extend and retract the group of control knobs in response to simultaneous selection of the first and second control knobs.

20. The appliance of claim 15, further comprising a processor coupled to a first control knob among the group of control knobs and a second control knob and configured to actuate the actuator to selectively extend and retract the group of control knobs in response to simultaneous selection of the first and second control knobs.

* * * * *